US007748643B2

(12) United States Patent
Renz et al.

(10) Patent No.: US 7,748,643 B2
(45) **Date of Patent: *Jul. 6, 2010**

(54) SPILL PROOF STRAW

(75) Inventors: Charles J. Renz, Briarcliff Manor, NY (US); Joshua S. Lieberman, Pompton Lakes, NJ (US)

(73) Assignee: Playtex Products, Inc., Westport, CT (US)

( * ) Notice: Subject to any disclaimer, the term of this patent is extended or adjusted under 35 U.S.C. 154(b) by 326 days.

This patent is subject to a terminal disclaimer.

(21) Appl. No.: 11/146,699

(22) Filed: Jun. 7, 2005

(65) Prior Publication Data

US 2005/0218242 A1 Oct. 6, 2005

Related U.S. Application Data

(63) Continuation of application No. 10/418,741, filed on Apr. 18, 2003, now Pat. No. 6,915,961.

(51) Int. Cl.
*A47G 21/18* (2006.01)

(52) U.S. Cl. ..... 239/33

(58) Field of Classification Search ..... 239/33; 424/473, 439, 451, 464, 489; 604/58, 85; 222/509, 175, 490; 224/148.2, 148.4
See application file for complete search history.

(56) References Cited

U.S. PATENT DOCUMENTS

| | | | | |
|---|---|---|---|---|
| 4,657,182 | A * | 4/1987 | Hoshi | 239/33 |
| 5,029,719 | A * | 7/1991 | Solomon | 215/229 |
| 6,116,457 | A * | 9/2000 | Haberman | 220/703 |
| 6,273,128 | B1 * | 8/2001 | Paczonay | 137/512.3 |
| 6,497,348 | B2 * | 12/2002 | Forsman et al. | 224/148.2 |
| 6,915,961 | B2 * | 7/2005 | Renz et al. | 239/33 |

* cited by examiner

*Primary Examiner*—Davis Hwu
(74) *Attorney, Agent, or Firm*—Ohlandt, Greeley, Ruggiero & Perle, L.L.P.

(57) ABSTRACT

There is provided a drinking straw assembly. The assembly has a first straw portion and a housing that can be removably secured to the first straw portion. The housing has a housing cavity, and a valve that can be removably connected to the housing cavity. The valve is also adapted to receive a second straw portion.

24 Claims, 4 Drawing Sheets

SPILL PROOF STRAW

This application is a continuation of, and claims priority in, U.S. Pat. application Ser. No.10/418,741, filed Apr. 18, 2003, now U.S. Pat. No. 6,915,961 the disclosure of which is incorporated herein by reference.

BACKGROUND OF THE INVENTION

I. Field of the Invention

The present invention relates generally to a drinking straw assembly. More particularly, the present invention relates to a drinking straw assembly having a valve adapted to be removably connected to a valve housing.

II. Description of the Prior Art

Liquid consumption is essential to support the lives of all human beings. Children require substantial amounts of liquid to allow for proper growth. Infants and toddlers often lack adequate dexterity to allow for successful consumption of liquid from an open cup. To this end, a number of training cups exist having a straw designed to facilitate consumption of liquid by children or others having limited dexterity.

However, use of a straw without a way to prevent liquid flow when not in use, especially by a small child, often results in the contents of the container being spilled. This is especially true when a small child, traveling in an automobile or the like, uses such a container. The result is a potentially unwanted condition in which, the child may become covered by the spilled material.

Valved drinking devices used as trainer cups provide a partial solution to this problem and are well known in the art. For example, U.S. Pat. Nos. 6,102,245 and 6,116,457, both to Haberman, provide for a drinking vessel having a valve means contained in a lid mouthpiece.

U.S. Pat. No. 5,085,349 to Fawcett provides a fluid supply chamber connected to a length of tubing having a closed end with a deformable slit. The tube can be received in a person's mouth to enable fluid to flow therethrough.

U.S. Pat. No. 4,607,755 to Andreozzi provides a children's drinking vessel with a flexible straw disconnectably mounted on a container and extendable substantially beyond the container. The outermost free end of the straw has a valve.

U.S. Pat. No. 4,196,747 to Quigley et al. provides a drinking tube connected to a one-way valve located in a liquid reservoir. The valve has a flapper enclosed within a valve chamber to prevent liquid from flowing back from the tube into the reservoir.

PCT Application Number PCT/NL93/00271 provides for a drinking system that has a check valve located near the downstream end of a straw to be held in the mouth.

U.S. Pat. No. 5,031,831 to Williams, III provides for a straw having a one-way flapper valve at the bottom of the straw to prevent liquid from falling back when the sucking action of the drinker ceases.

While the art provides for valved drinking systems, missing in the art is a drinking straw assembly having a valve adapted to be removably connected to a valve housing. Another missing feature in the art is a straw assembly having a removable valve that is easy to clean, thereby insuring proper hygiene along with proper functioning of the valve in the straw assembly.

Applicant has discovered an improved drinking straw assembly having an easy to clean valve that can be removably connected to a valve housing. This assembly is suitable for use in a trainer cup and other applications.

SUMMARY OF THE INVENTION

It is an object of the present invention to provide a drinking straw assembly having a housing adapted to be secured to a first straw portion, and a valve seat having a valve or valve membrane adapted to be removably connected to the housing.

It is another object of the present invention to provide such a drinking straw assembly in which the valve seat is easily disassembled from the housing for cleaning.

It is still another object of the present invention to provide such a drinking straw assembly in which the valve membrane having at least one slit therein.

It is yet another object of the present invention to provide such a drinking straw assembly in which the valve membrane is concave.

It is a further object of the present invention is to provide such a drinking straw assembly in which the valve seat can operable receive a second straw portion.

To accomplish the foregoing objectives and advantages, the present invention, in brief summary, is a drinking straw assembly having a housing that can be secured to a first straw portion, and a valve seat that can be removably connected to the body. The valve seat can receive a second straw portion positioned in a container and control the flow of fluid in the container from the second straw portion to the first straw portion. The valve seat has a membrane with at least one slit therein. The valve membrane is concave. Preferably, the drinking straw assembly is formed from flexible material.

DETAILED DESCRIPTION OF THE INVENTION

Figure 1:
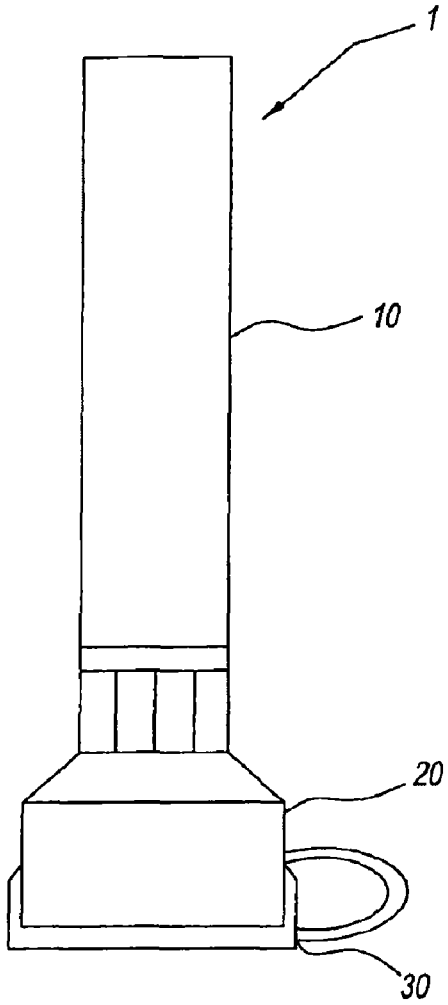
FIG. 1 is a plan view of the drinking straw assembly according to the present invention.
Figure 4:
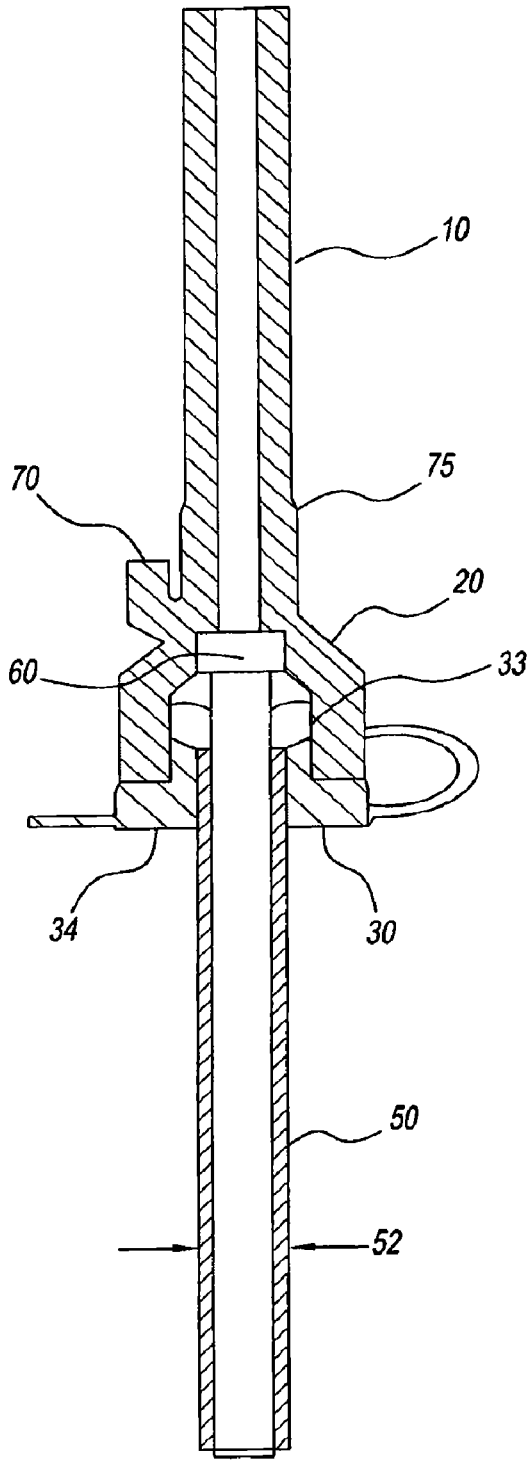
FIG. 4 is a cross-sectional view of the drinking straw assembly according to the present invention, having a second straw portion.

Referring to the figures and, in particular, FIG. 1, a drinking straw assembly according to the present invention is generally represented by reference numeral 1. The drinking straw assembly 1 has a first straw portion 10, a housing 20 that is adapted to receive, at one end thereof, the first straw portion, and a valve seat 30 that can be removably positioned in a portion of the hollow cavity of the housing. As shown in FIG. 4, straw assembly 1 includes or is adapted to include a second straw portion 50 that would be positioned in a container having a fluid or liquid, such as, for example, milk, therein.

Figure 2:
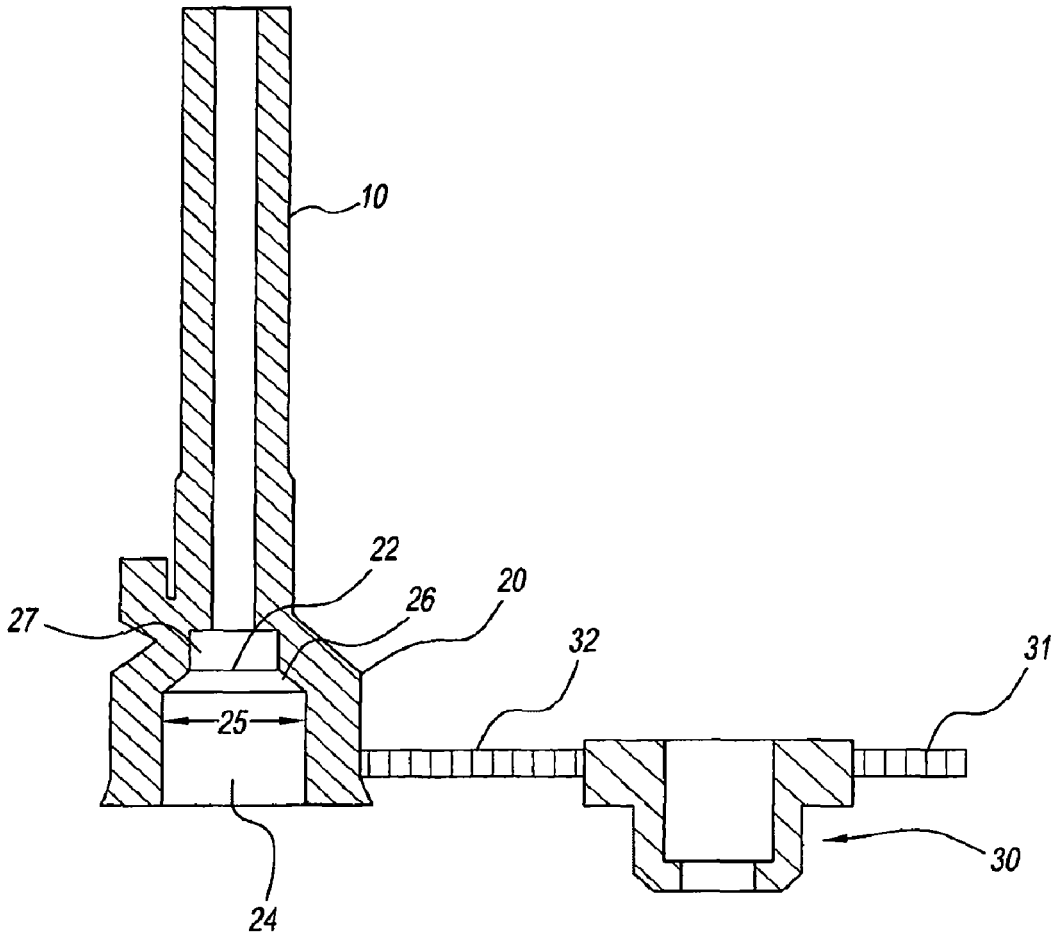
FIG. 2 is a cross-sectional view of the drinking straw assembly of FIG. 1 in an open position.

Referring to FIGS. 1 and 2, housing 20 has a hollow channel 22 therethrough with an enlarged housing cavity 24. The housing cavity 24 has a sloping wall 26 that is terminates in a circular wall 27. Circular wall 27 can receive an end of first straw portion 10. However, more preferably, first straw portion 10 is integrally connected or molded to housing 20 at wall 27. Preferably, first straw portion 10 and circular wall 27 are cylindrical in shape. Also preferably, housing 20, valve seat 30 and housing cavity 24 are basically cylindrical in shape.

The housing cavity 24 has an inner diameter 25 that can frictionally engage the outer wall of valve seat 30. In a preferred embodiment, the inner diameter of housing cavity 24 is preferably about 0.4 inches to about 0.7 inches, subject to a tolerance of plus or minus about 0.025 inches, and more preferably about 0.5 inches to about 0.6 inches. Accordingly, the outer diameter 35 of valve seat 30 is just slightly smaller than inner diameter 25 of housing cavity 24.

First straw portion 10, housing 20 and valve seat 30 are preferably made of a flexible material, most preferably from an elastomeric material. The elastomeric material that can be used in the present invention is silicone, natural rubber, synthetic rubber (e.g., isoprene), TPE (thermoplastic elastomer), or any combinations thereof. Most preferably, the elastomeric material is silicone.

In the embodiment shown in FIG. 2, valve seat 30 has been removed from housing cavity 24 of housing 20. This is the position for cleaning of the assembly 1. The valve seat 30 has a gripping tab 31, and is attached to housing 20 via a tether 32. Preferably, tether 32 is a thin, very flexible tether. The tab 31 and tether 32 allow the consumer to disassemble valve seat 30 from housing 20 for cleaning, while retaining the valve seat for subsequent use. The tethering of valve seat 30 to housing 20 also provides for a larger total assembly, which is far less likely to be ingested by a small child than would be an untethered valve alone.

Figure 3:
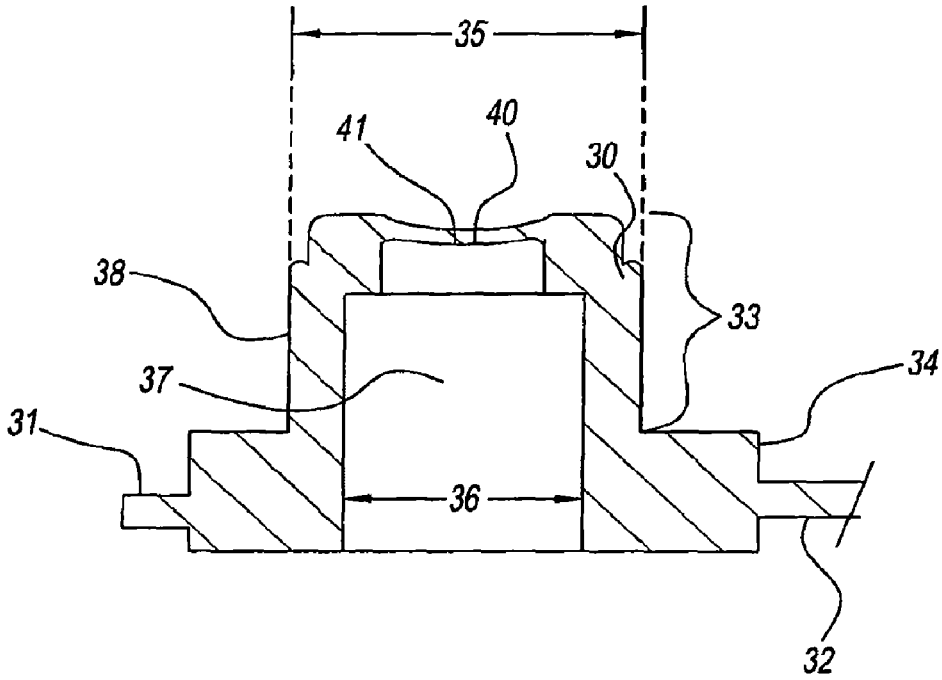
FIG. 3 is an exploded cross-sectional view of the valve seat of the drinking straw assembly of FIG. 1.

As shown in FIG. 3, valve seat 30 has a lower portion 34 and a stack 33 protruding from the lower portion. As shown in FIG. 3, valve seat 30 has an external diameter 35, namely from outer wall 38, which is sufficient to frictionally engage the inner walls of housing cavity 24. The stack 33 and lower portion 34 of valve seat 30 define a valve cavity 37 having a valve cavity diameter 36. The valve cavity diameter 36 permits significant, relatively unconstrained fluid flow to the area of the slit. Preferably, valve cavity 37 is substantially cylindrical, and presents a simple, wide opening to enable thorough cleaning of valve seat 30 after use. This design also minimizes the number of corners and niches in which dried or congealed liquid can be deposited.

Also, valve seat 30 has a membrane or valve membrane 40 having at least one slit 41 therein. Optionally, slit 41 can be two or more slits that intersect. In a preferred embodiment, slit 41 is a pair of slits that intersect essentially at the midpoint of the slits to form a cross.

The valve membrane 40 can be flat, but is preferably curved. Most preferably, valve membrane 40 is concave in the direction towards the lower portion of valve seat 30. Ideally, valve membrane 40 has a dome shape.

Preferably, the inside diameter of the dome shape of valve membrane 40 is about 0.20 inches to about 0.40 inches, more preferably about 0.27 inches to about 0.37 inches and most preferably about 0.32 inches. The outside diameter of the dome shape of valve membrane 40 is about 0.30 inches to about 0.60 inches, more preferably about 0.40 inches to about 0.50 inches and most preferably about 0.44 inches. In addition, the thickness of valve membrane 40 is preferably about 0.01 inches to about 0.04 inches, and more preferably about 0.025 inches. This dimension has been found to be very important in providing proper flexion of valve membrane 40 and opening of the slit under suction during use.

FIG. 4 shows straw assembly 1 of the present invention equipped with second straw portion 50. The second straw portion 50 can be operably connected to valve seat 30. The second straw portion 50 has an outer diameter 52 sufficient to frictionally engage valve cavity 37 shown in FIG. 3. In a preferred embodiment, second straw portion 50 is a rigid straw, made of a hard, rigid polymeric material. Most preferably, second straw portion 50 is made from polyethylene, polypropylene, or a combination thereof.

The length of stack 33 as measured from valve membrane 40 to lower portion 34, enables placement of valve membrane 40 in close proximity to first straw portion 10 within housing 20. Also, valve membrane 40 is placed in the liquid path between first straw portion 10 and second straw portion 50. Preferably, the length of stack 33 is sufficient to provide spatial clearance 60 between valve membrane 40 and first straw portion 10 sufficient to allow the valve membrane to open when negative pressure is applied to the first straw portion. This allows fluid to flow from second straw portion 50 through valve membrane 40 and first straw portion 10 to the user of the container. Thus, sucking on first straw portion 10 activates valve membrane 40 to permit the flow of fluid from second straw portion 50 to and through the first straw portion and then to the person sucking on the first straw portion.

In a preferred embodiment, drinking straw assembly 1 of the present invention can be equipped to removably engage a suitable container lid (not shown). This engagement is achieved through the use, for example, of a notch or a tab 70, and/or through a flange portion 75.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims.

What is claimed is:

1. A drinking assembly for use with a container lid and a container having a straw, the assembly having a proximal end, and a distal end remote from the proximal end, comprising:

a first straw portion having a first straw, said first straw being at the proximal end of the drinking assembly for use in the mouth of a user, and said first straw portion having a distal end portion for removable engagement of the drinking assembly to the container lid;

a housing connected to said distal end portion of said first straw portion, and being disposed in the container lid or the container distal of the removable engagement of the drinking assembly to the container lid, said housing defining therein a first cavity distal of said first straw portion, said first cavity frictionally removably receiving a valve seat therein; and a valve seat removably positioned in said first cavity of said housing, said valve seat having a pressure sensitive valve for preventing a flow of liquid into said first straw portion, wherein said valve seat has therein a lower portion that defines a valve cavity distal of said valve and for internally receiving and operably frictionally engaging the straw of the container, wherein said valve is a flexible membrane having a slit therein, said slit being normally closed and being openable when negative pressure is applied to said first straw portion and through it to said slit, and wherein said housing, said first cavity, said valve seat, said valve, and said valve cavity are disposed in the container lid or the container.

2. The drinking assembly of claim 1, wherein said first cavity of said housing frictionally engages said valve seat.

3. The drinking assembly of claim 1, further comprising a flexible tether.

4. The drinking assembly of claim 3, wherein said flexible tether connects said valve seat to said housing.

5. The drinking assembly of claim 1, wherein said valve seat has a gripping tab.

6. The drinking assembly of claim 1, wherein said valve seat forms a stack, and said membrane is at a top portion of said stack.

7. The drinking assembly of claim 1, wherein said membrane is concave in a direction towards a lower portion of said valve seat.

8. The drinking assembly of claim 1, wherein said slit is a pair of slits.

9. The drinking assembly of claim 8, wherein said pair of slits define a cross.

10. The drinking assembly of claim 1, wherein said membrane opens only when negative pressure is applied to said straw portion.

11. The drinking assembly of claim 1, wherein said valve seat is tethered to said housing.

12. The drinking assembly of claim 1, wherein said housing is substantially round.

13. The drinking assembly of claim 1, wherein said straw portion, said housing and said valve seat are made of a flexible material.

14. The drinking assembly of claim 13, wherein said flexible material is selected from the group consisting of silicone, natural rubber, synthetic rubber, thermoplastic elastomer, or any combinations thereof.

15. The drinking assembly of claim 1, wherein said valve cavity of said valve seat frictionally engages the straw of the container.

16. The drinking straw assembly of claim 1, wherein said housing is integrally molded to said first straw portion.

17. The drinking assembly of claim 1, wherein said distal end of said first straw portion includes a notch or a tab and/or a flange portion for removably engaging said drinking assembly to a container lid.

18. A drinking straw assembly for use with a container lid and a container, the assembly having a proximal end and a distal end remote from the proximal end, comprising:

a first straw portion, said first straw portion being at the proximal end of the assembly for use in the mouth of a user, and having a distal end portion for removable engagement of the assembly to the container lid;

a second straw portion having an upper end;

a housing connected to said distal end portion of said first straw portion, said housing being disposed under the container lid distal of the removable engagement of the assembly to the container lid, said housing having a housing cavity distal of said first straw portion for frictionally receiving a valve seat therein; and a valve seat removably connected to said housing cavity, said valve seat having therein a pressure sensitive valve, and a valve cavity distal of said valve that receives therein said upper end of said second straw portion, wherein said first straw portion, said valve and said second straw portion are in communication so that said valve permits a flow of liquid into said first straw portion from said second straw portion upon application of a negative pressure to said first straw portion, and wherein said housing, said housing cavity, said valve seat, said valve, said valve cavity and said second straw portion are disposed in the container lid or the container.

19. The drinking straw assembly of claim 18, wherein said valve is a membrane having a slit therein.

20. The drinking straw assembly of claim 19, wherein said membrane is positioned across an upper portion of said valve seat.

21. The drinking straw assembly of claim 20, wherein said membrane is concave in a direction towards a lower portion of said valve seat.

22. The drinking straw assembly of claim 20, wherein said slit is a pair of slits defining a cross.

23. The drinking straw assembly of claim 18, wherein said housing is integrally connected to said straw portion.

24. The drinking assembly of claim 18, wherein said distal end of said first straw portion includes a notch or a tab and/or a flange portion for removably engaging said drinking assembly to a container lid.

* * * * *